US006592714B2

(12) United States Patent
Lamb

(10) Patent No.: US 6,592,714 B2
(45) Date of Patent: Jul. 15, 2003

(54) PAPER-MAKING-MACHINE FABRIC AND TISSUE PAPER PRODUCED THEREWITH

(75) Inventor: Hans-Jürgen Lamb, Gernsheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 09/969,733

(22) Filed: Oct. 4, 2001

(65) Prior Publication Data

US 2002/0088596 A1 Jul. 11, 2002

Related U.S. Application Data

(63) Continuation of application No. PCT/EP00/02972, filed on Apr. 4, 2000.

(30) Foreign Application Priority Data

Apr. 20, 1999 (DE) ..... 199 17 832

(51) Int. Cl.[7] ..... D21F 7/12; D03D 3/04

(52) U.S. Cl. ..... 162/116; 162/902; 162/903; 139/383 A; 442/203

(58) Field of Search ..... 162/109, 110, 162/111, 114, 115, 116, 117, 121, 306, 348, 358.2, 358.4, 900, 902, 903; 139/383 A, 383 AA, 425; 34/116; 245/2; 28/110, 142; 442/203–207

(56) References Cited

U.S. PATENT DOCUMENTS 3,432,936 A * 3/1969 Cole et al. ..... 162/115
5,211,815 A * 5/1993 Ramasubramanian et al. ..... 138/383 A
5,431,786 A * 7/1995 Rasch et al. ..... 139/383 R
6,120,642 A * 9/2000 Lindsay et al. ..... 162/109

FOREIGN PATENT DOCUMENTS

| | | |
|---|---|---|
| DE | 3008344 | 9/1980 |
| DE | 3600530 | 7/1987 |
| EP | 724038 | 7/1996 |
| WO | 96/04418 | 2/1996 |
| WO | 97/32081 | 9/1997 |
| WO | 98/10142 | 3/1998 |

* cited by examiner

*Primary Examiner*—Steven P. Griffin
*Assistant Examiner*—Eric J Hug
(74) *Attorney, Agent, or Firm*—Burns, Doane, Swecker & Mathis, LLP

(57) ABSTRACT

The invention relates to a paper machine clothing, notably an air-dry clothing (TAD clothing), in the form of a woven having a weaving design. According to the invention the relative depth of machine clothing cups which are open towards the contact surface of the paper is 20% or more, said relative cup depth being the quotient of the difference between the measurement height for which the bearing percentage is 30% and the measurement for which the bearing percentage is 60%, on the one hand, and the sum of the diameters of a warp thread and a weft, on the other hand. The measurement height "0" is the outer limit of the paper machine clothing on the paper contact surface, the bearing percentage is the projected sectional area of the threads of the woven at a given measurement height in relation to the measurement surface, the section areas being parallel to the surface of the clothing. The invention also relates to a tissue paper product which is produced with such a clothing and is especially voluminous in direction Z.

12 Claims, 15 Drawing Sheets

BST

44 GST

44 MST

SCA 1

SCA 2

SCA 3

SCA 4

SCA 5

PAPER-MAKING-MACHINE FABRIC AND TISSUE PAPER PRODUCED THEREWITH

This application is a continuation of International Application No. PCT/EP00/02972 filed on Apr. 4, 2000, which International Application was published by the International Bureau in German on Oct. 26, 2000, the entire contents of which are hereby incorporated herein by reference.

BACKGROUND OF THE INVENTION

1. Field of the Invention

The technical field of the invention relates to the production of tissue paper on a corresponding paper-making machine in which more particularly a through air drying (TAD) zone is provided. In this TAD zone a special imprinting fabric is employed.

2. Prior Art

The sheet formation of the paper and the three-dimensional structuring of an already formed moist fiber felt which is still deformable, however, due to a remaining high water content, is usually done on backing woven fabrics stemming from textile weave processes.

Three-dimensionally structuring a moist paper web by forming zones of low density framed by dense zones is undertaken in modem tissue making machines in the course of predrying the sheet in a predrying section upstream of the yankee cylinder. Predrying the paper web occurs on the backing fabric by convection in forcing hot air through the paper web located on the backing fabric. This is termed through air drying (TAD).

Three-dimensional structuring is usually implemented in three steps mostly sited separately in sequence. The first step involves deflecting the fibers in the Z direction into the structuring depressions in the backing fabric made available by the TAD imprinting fabric systematically distributed over the surface area of the backing fabric contacting the paper. Deflecting the fibers in the Z direction is prompted by a flow of air and water, vacuum-assisted by one or more vacuum boxes arranged on the side of the backing fabric opposite the side in contact with the paper.

Deflecting the fibers in the Z direction into the interior of the depressions results in zones of reduced density in the paper sheet which are termed pillows. These zones of reduced density arranged in a pattern are dried in a second step on or in the interior of the backing fabric by the air flowing therethrough of one or more TAD cylinders and thus set in the existing distribution of the fibers, i.e. "freezing" the fiber distribution status.

Then, in a third step partial compression of the predried fiber felt takes place by pressing the backing fabric with the predried web of paper located thereon with the aid of a compression roller against the surface of the yankee cylinder. Compression of the paper web occurs in the raised portions of the backing fabric which may be formed by both warp and weft wires in the predefined portions of the backing fabric surface. The fibers located in the depressions of the backing fabric receive no compression. TAD imprinting fabrics as the backing fabric represent a special type of fabric comprising typical structurizing properties by their weave, choice of wire as regards material, diameter, cross-sectional shape and after-treatment, for example, heat setting and grinding of the surface.

Paper-making-machine fabrics are known for example from WO 96/04418, DE-OS 30 08 344, EP 0 724 038 A1.

SUMMARY OF THE INVENTION

The technical problem (object) of the invention involves providing a paper-making-machine fabric which is suitable and configured, as regards a tissue paper having an enhanced three-dimensional surface structure in the form of a sequence of pillows and pockets, to achieve a tissue paper of enhanced visual appeal, improved softness and greater volume in conjunction with an improved water absorption and better feel.

This problem is solved more particularly by the features of claim 1.

Due to the solution in accordance with the invention a paper-making-machine fabric is provided in which exceptionally deep pockets are provided with the result that more particularly in the TAD zone with this paper-making-machine fabric a paper and, more particularly, a tissue paper is producible which features an exceptionally large three-dimensional structure as regards an increase in the specific volume which makes the paper appear particularly fluffy and features in addition to exceptional softness also exceptionally good water absorption. In addition to this, an enhanced similarity to a woven structure and thus to the look and feel of cloth is achieved.

With the paper-making-machine fabric as described, a paper structure is producible having a large number of pillow-like zones of reduced density provided systematically distributed over the full surface area of the fiber felt. The extent of the pillow-like zones of reduced density in the Z direction, i.e. their thickness, is a maximum relative to their size in surface. Each low-density pillow-like zone is evidently separated from its adjacent pillow-like zone by a line-type frame of increased density, this line-type frame being formed continuously or discontinuously by interruptions. The line portions visually appearing continuous are characterized by a greatly increased, even density as compared to the low-density of the pillow-like zones. If the line portions are interrupted, the line portions in the region of this interruption feature a low density as compared to that of the continuously appearing line portions which, however is significantly higher as compared to that of the pillow-like zones.

The line-type frames dictate the surface-area extent of the pillow-like zones. The entirety of the pillow-like zones with their line-type frames furnishes a visually obvious macroscopic distribution pattern which is typical for TAD imprinting fabric used for structuring and its weave and finish.

In this arrangement the three-dimensional structure produced in the fiber felt with its typical pattern is the mirror image of the three-dimensional structure and distribution pattern of the fabric used in production. More particularly when employing TAD and more particularly when increasing the density as mentioned above is undertaken at the drying cylinder the tissue papers produced in accordance with the invention feature, as compared to non-structured tissue papers produced conventionally, a significantly increased specific volume with added fluffiness as well as an enhanced absorption capacity for liquids, especially water.

Also as compared to conventional TAD paper-making-machine fabrics the TAD paper-making-machine fabrics in accordance with the invention produce a paper having a significantly increased specific volume, added fluffiness and improved liquid absorption capacity.

Further aspects read from the sub-claims. A further increase in the depth of the pockets is achievable by the features of claim 2. From the remaining sub-claims a series of example embodiments materializes.

BRIEF DESCRIPTION OF THE DRAWINGS

Illustrated in the drawings are example embodiments of the invention in which.

DESCRIPTION OF EXAMPLE EMBODIMENTS OF THE INVENTION

Figure 1:
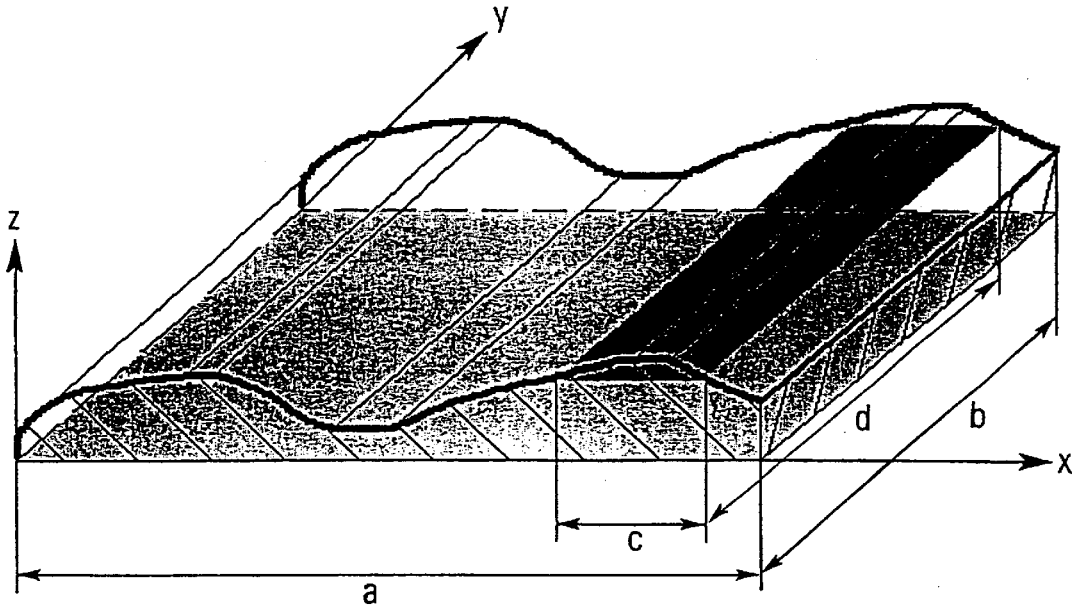
FIG. 1 is a schematic three-dimensional drawing illustrating the definition of the bearing-area-percentage.

The system for measuring the fabric will now be explained by way of a SCA-1-type fabric in accordance with an embodiment of the invention. The term "screen" will be used thereby synonymously for fabric.

I. UBM Measuring System

Triangulation sensor OTM2 of the Company Wolf & Beck

Controller: base unit RS 232 incl. sync socket

Table: (DC(Galil) motor controlled measuring table with 2 axes;

Travel: 50 mm; lateral resolution per axis <1 $\mu$m

This system is furnished complete by the Company UBM Messtechnik GmbH (Ottostr. 2, D-76275 Ettlingen).

TABLE 1

General operating data, accuracy and laser data of the triangulation sensor OTM2

| General operating data | | Accuracy | |
|---|---|---|---|
| Work spacing (front lens <–> measuring range middle) | 45 ± 1 mm | Brightness dynamics (single sensor setting sufficient for operation from bright aluminium surface to black rubber material) | 25 dB |
| Measuring range | 10 ± 1 mm | | Measuring capability dull black reference surface to a sampling angle of 45° |
| Resolution | 1 $\mu$m | Reproducibility | |
| | | for inclination <5° on reference standard | <0.005 mm |
| | | for inclinations >5° to 60° | <0.01 mm |
| Surface suitable for measuring | Diffuse | Maximum linearity error | |
| | Partly reflecting | for inclination <5° on reference standard | <0.02 mm |
| | | for inclinations >5° to 60° | <0.05 mm |
| Temperature range | +10–+40° C. | Maximum stray light influence (change in ambient brightness from radiation intensity 0 to 100 W/m2) | <0.005 mm |
| Relative humidity | 80% | Maximum temperature drift (10–40° C.) | <0.02 mm |
| Laser data | | Influence of surface inclination profile section over a reference ball angular range ± 60°) maximum deviation | 0.05 mm |

TABLE 1-continued

General operating data, accuracy and laser data of the triangulation sensor OTM2

| General operating data | | Accuracy | |
|---|---|---|---|
| Laser wavelength | 750 nm | Influence of surface color measured from 10 color reference samples over full measuring range | 0 mm |
| Minimum laser power (pulsed) | <0.4 mW | Maximum measuring deviation | <0.03 |

Pulse frequency = measuring repetition rate 20 kHz

The triangulation sensor OTM2 is an optoelectronic laser sensor for non-contact distance measuring and comprising a sensor head and controller.

The sensor head is designed as a coaxial arrangement of emitter/detector optics. The emitter optics comprise a visible semi-conductor laser including collimator optics. The laser beam has a low aperture and emerges centrally from the sensor head. The light reflected diffusely from the surface is analyzed rotationally symmetrical (360°) and contributes primarily to the gain in result. A mechanical structure having no moving parts permits high acceleration of the sensor head also during measuring.

To avoid stray light interference the intensity of the laser beam is modulated at a high frequency. The emitted beam power is regulated as a function of the measuring conditions. Thus reliable measuring of surfaces greatly differing in reflectivity is ensured. The detected signals are conditioned and digitized in the sensor head to thus ensure high immunity of the communication between sensor head and controller to interference.

The controller contains a digital circuit for linearizing and time-filtering the measured data. The results being output via this interface.

Table 1 provides an overview of the general operating data, measuring accuracy and laser data.

The measured data are stored in a data file and are available for processing by the UB Soft 1.9 software. Exporting the data in Excel is not possible, however.

II. OPTIMAS 6.0 Software (Image Analysis)

This software is available from the Company Stemmer Imaging GmbH (Guten-bergstr. 11, D-82178 Puchheim).

III. Definition of Bearing-area-percentage

The bearing-area-percentage in the sense of the invention describes the respective percentage of the sectional area through the material relative to the total area. The bearing-area-percentage is then defined by the percentage of the area c×d relative to the total area a×b (FIG. 1). Fabrics having a very coarse structure feature only a slight increase in the bearing-area-percentage when the change therein is related to the change in height.

IV. Specimen Preparation

1. A 50×50 mm large piece is parted from the fabric SCA 1 by means of a soldering iron so that the edge of the fabric does not fray and the specimen remains dimensionally stable. However, the size of the specimen is generally freely selectable. Selecting the area to be sensed and measured within the size of the specimen depends on the weave pattern of the fabric so that any edge interference distorting the results is practically eliminated. For an 8 shed fabric having thread diameters of 400×450 $\mu$m the area to be measured must thus be greater than 7×7 mm.

2. The rear side (in contact with the glass plate serving as the support material) of the fabric is rubbed with emery cloth so that the contact surface area is uniform and protruding pieces of thread released due to parting of the specimen are removed.

3. Clean fabric specimen with compressed air.

4. Bond fabric specimen by double-sided sticky tape to a glass plate corresponding in size to that of the fabric specimen (50×50 mm). By it being fixed to the glass plate the fabric is prevented from corrugating and a flat surface is assured, i.e. the fabric remains dimensionally stable.

5. Spray fabric specimen with Blow-Flag (a removable masking ink, US production) to ensure uniform reflection as needed for the laser sensor. Metering the corresponding amount of masking ink is necessary since spraying too much may clog the cavities in the fabric whilst too little diminishes the reflection.

Figure 2:
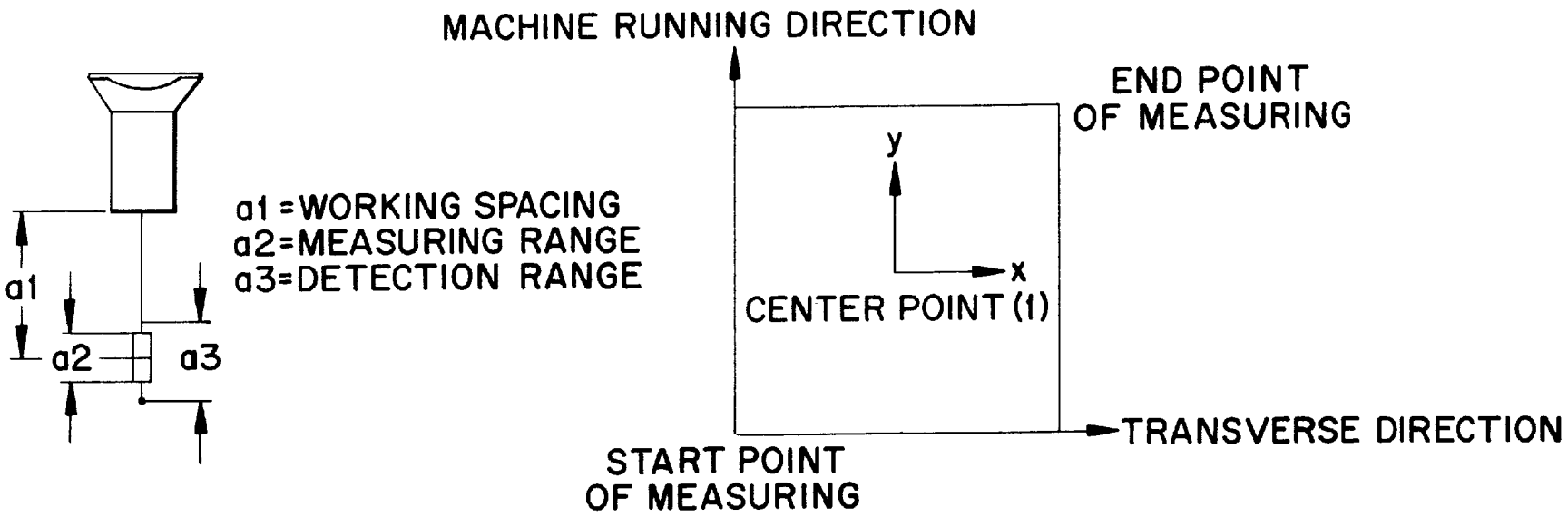
FIG. 2 is an illustration showing the sensor of the measuring means and the measuring direction, with a1=working spacing, a2=measuring range, a3=detection range, showing the machine running direction, the end point of measuring, the centerpoint, the starting point of measuring, and a transverse direction.
Figure 3:
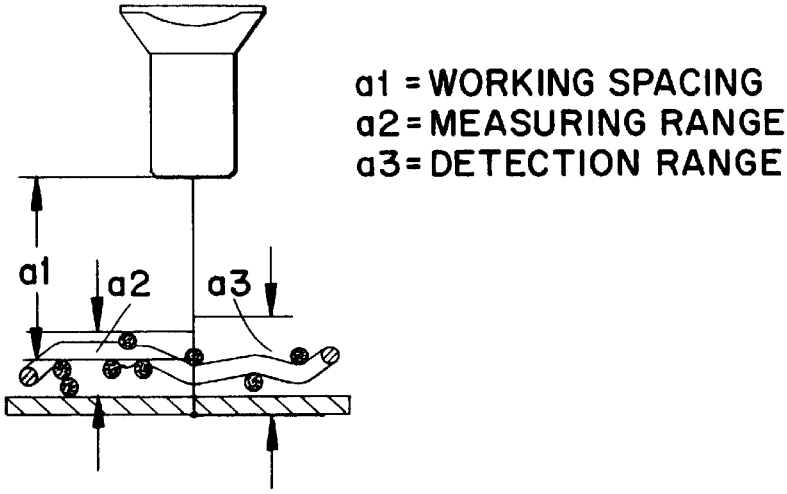
FIG. 3 is an illustration showing a fabric specimen under the triangulation sensor.

6. The specimen as prepared according to items 1 to 5 is then placed on the measuring table, taking into account the machine running direction of the fabric (see FIG. 2), so that the machine running direction of the fabric coincides with one axis (y-coordinate direction) of the 2-axes measuring table. Installed above the measuring table is the triangulation sensor (FIG. 2). Aligning the specimen in the machine running direction is done by eye and is thus not always exact. FIG. 3 shows the specimen under the triangulation sensor indicating the measuring range, working spacing and detection range.

V. UBSoft Software Settings (see FIG. 2)

1. Measuring distance: 12 mm, point density: 50 points/mm in machine running direction and transversely thereto, i.e. 600×600 points are detected per measurement. The size of the measuring area to be selected is dictated by the repeat of the pattern. Thus, e.g. for an 8-shed fabric a surface area greater than 8×8 threads is measured.

2. Measuring is done incrementally by automatic advancement of the measuring table with the specimen affixed thereto along the two advancement axes at a "scanning rate" which is independent of the measuring frequency. The scanning rate is 3 mm/s.

The travel of the specimen is indicated schematically on the right in FIG. 2. The starting point for measuring is the center-point (1), i.e. measuring starts at the center of the surface area. This is followed by an idle travel to the lower left-hand point of the surface area where actual measuring commences. On completion of measuring after approx 11 h in the top right-hand corner, an idle travel is instrumented to the starting point. The measuring direction in this procedure is "forwards", i.e. measuring is instrumented in forwards movement of the table in the traverse and machine running direction.

3. Only the results of measuring the profile are recorded.

VI. Analysis Using UBSoft Software

1. Since, despite utmost care, it is impossible to locate the specimen planoparallel under the sensor, the measured surface area needs to be initially aligned with the aid of mathematical methods on the basis of the measured results to ensure that it appears planoparallel. For this purpose two different tools (linear regression and contact surface area) are available.

The "linear regression" tool aligns a measuring sequence on the basis of a regression plane. The plane is generated by the least squares method from the points measured and plotted in the measuring graphics and then subtracted from the measured data file.

The "contact plane" tool aligns the measured area according to the three highest points.

For the SCA-1 fabric a height of 2638 μm is measured (maximum 1006 μm, min–1632 μm). The measured area is aligned by the "contact plane" tool, resulting in a height of 2628 μm (maximum: 0 μm, min: −2628 μm).

Figure 4:
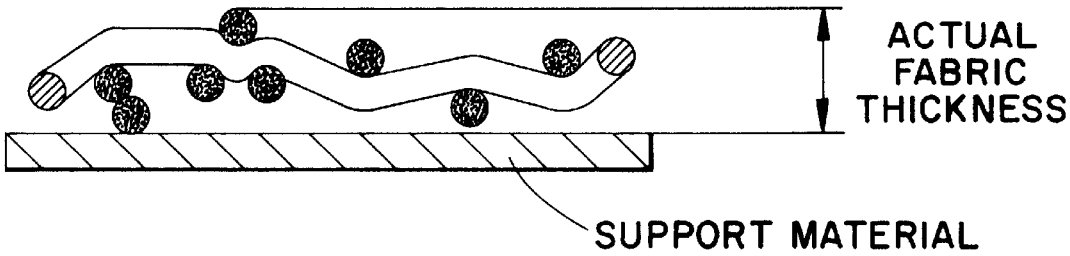
FIG. 4 is a rough drawing illustrating the actual cross-section of a TAD fabric with support material, showing the actual fabric thickness and the support material.
Figure 5:
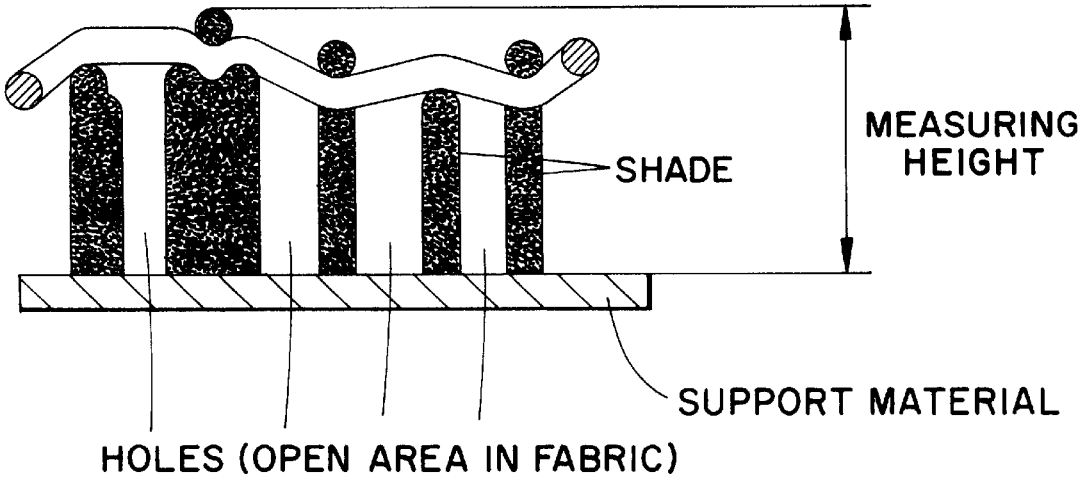
FIG. 5 is a rough drawing illustrating the measuring result, showing the shade, the measuring height, and the support material.

2. Due to the open area or "holes" in TAD fabrics the graphical representation of the measuring result is not the same as the actual fabric (FIG. 4). As evident from FIG. 5 the optically closed area percentages of the fabric appear deeper or thicker than the spacing of the surface of the support material to the laser sensor as measured, whereby the surface of the support material serves as the reference plane. This results from the difference in the reflection factors of fabric and support material. The actual thickness of the fabric SCA 1 as measured by a thickness tester (as per EN 12625-3: 1999) is 1778 μm.

3. Since pre-treating the fabric with Blow-Flag has ensured a uniform reflectivity of all wires of the fabric (screen) and only the differences in height between the surface of the warp and weft wires forming the fabric are of interest, mal-measuring the absolute spacing to the surface of the support material (reference plane) is irrelevant for all practical purposes and can thus be eliminated by scaling.

Figure 6:
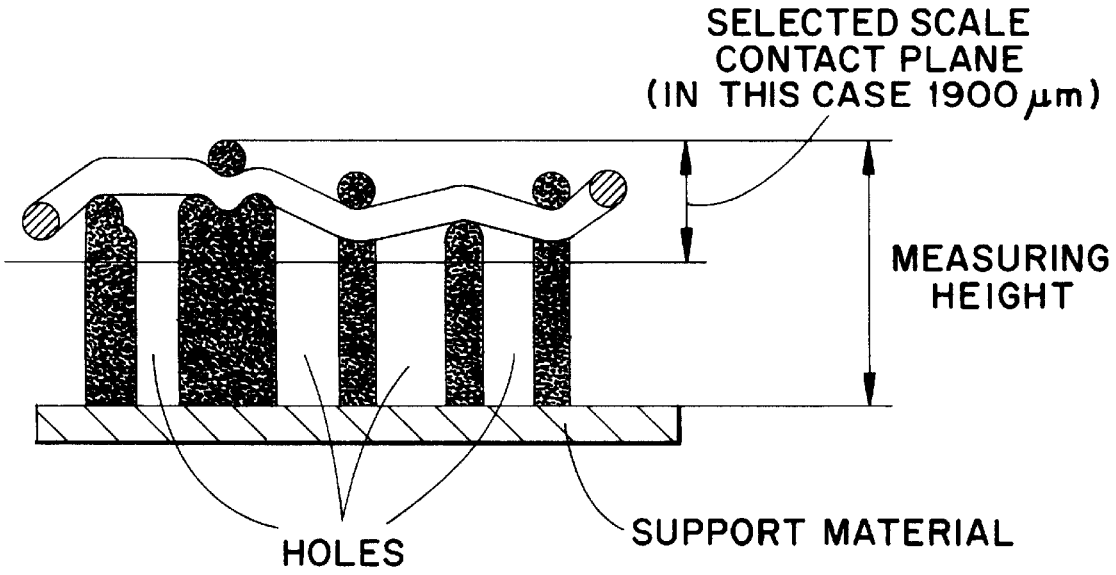
FIG. 6 is a rough drawing illustrating the selected scaled contact plane, (in this case 1900 $\mu$m), showing the measuring height and the support material.

4. Since the fabric "measuring height" (2628 μm) is substantially greater than the actual fabric thickness (1778 μm), the heights are firstly defined or scaled to 1900 μm (max: 0 μm, min: −1900 μm), this definition in the height being selected as a function of the actual fabric thickness. Should this amount to more than 1900 μm, all fabrics must be defined to a higher degree (FIG. 6). This is why comparing the established results must only be done on specimens defined to the same degree.

5. Due to its internal analysis software and due to having suitably selected the measuring point spacing, the measuring system is able to "see" structurally associated values equi-spaced from the sensor (height, thickness). Structurally associated in this measuring procedure means that the measuring points to be analyzed are associated in each case to an explicitly defined surface, e.g. that of a single warp or weft wire.

Combining structurally associated points equi-spaced from the sensor (i.e. having the same height/thickness) produces the heights or contour lines forming the definition of the section plane to the fabric material, i.e. the warp and weft wires sectioned by the section plane in a specific height. It is from the spacing of contour lines of structurally associated elements of the fabric that the section areas assigned to a specific height and termed "bearing-area-percentage" can be computed. It is to be noted that as of the largest expansion of the warp or weft wires only the projected area and not the actual area is taken into account.

6. Exporting the bearing-area-percentage curves from the UBSoft data file into another program is not possible with the existing facilities. This is why the aligned, defined areas are thus converted into the image data files (8-bit gray display, TIF format) for subsequent further processing by the OPTIMAS image analysis software.

VII. OPTIMAS 6.0 Analysis

Figure 7:
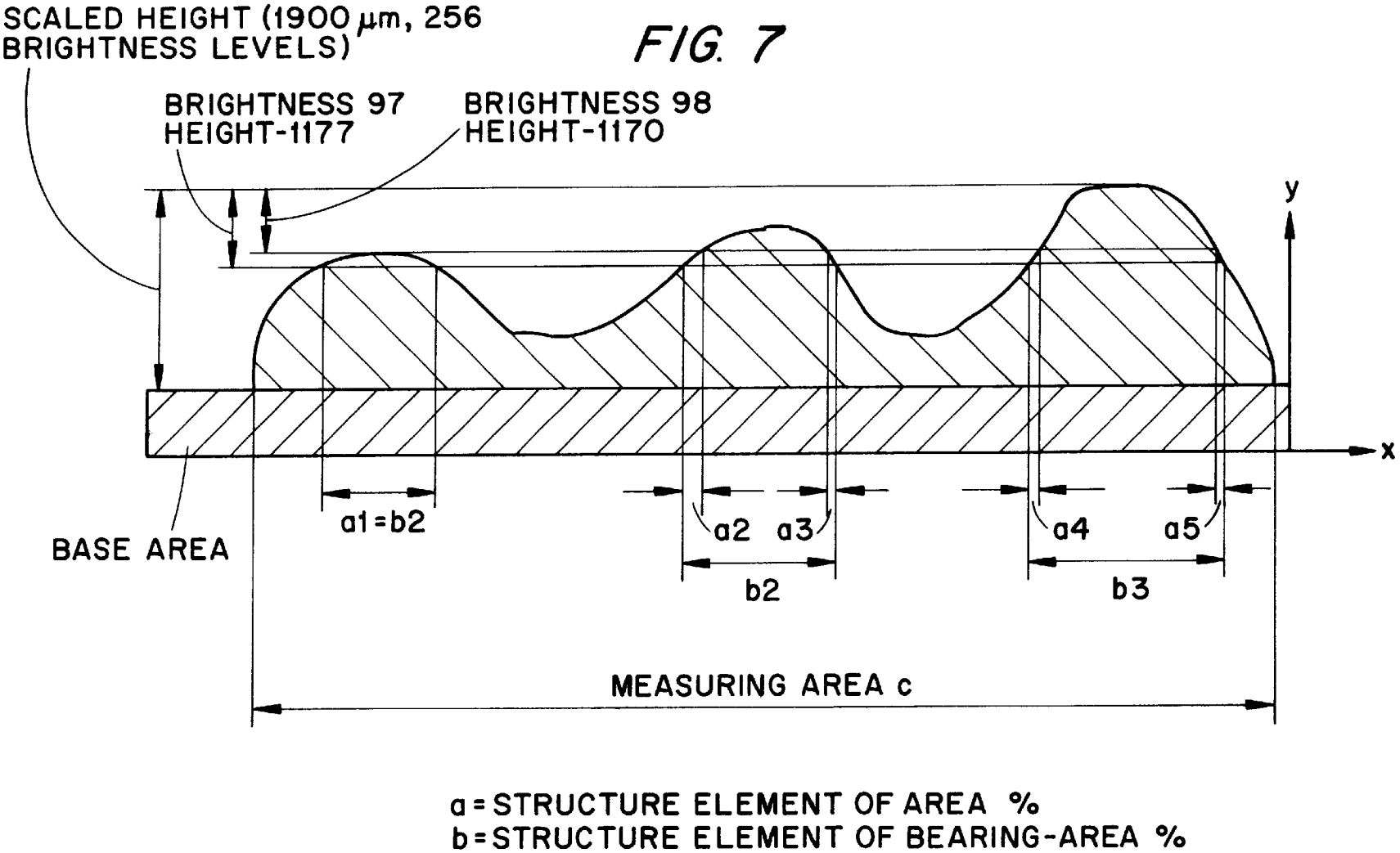
FIG. 7 is a cross-sectional illustration defining relative area-percentage and the bearing-area-percentage as shown in FIG. 1, (1099 $\mu$m, 256 brightness levels), showing the scaled height, the brightness, the height, the base area, a=structure element of area %, b=structure element of bearing-area- %, and the measuring area.

1. Making the conversion into an 8-bit TIF data file means that the 1900 μm difference in height is converted into 256 brightness levels (0 to 255), i.e. maximum: brightness level 255=0 μm; min: brightness level 0=−1900 μm). Using the PercentArea tool (rel. area percentage) the relative area-percentage of each of the 256 brightness levels is determined. This means that unlike the bearing-area-percentage not the structural elements of the fabric assigned to a section plane are established but the structural elements associated with a brightness level. Illustrated by way of example in FIG. 7 is a portion of the FIG. 1 as a two-dimensional drawing to show the difference between relative area-percentage and bearing-area-percentage. In this arrangement a1 to a5 are the structural elements of a brightness of 97 or height of −1177 μm. These structural elements of the relative area-percentage take into account only the brightness for a specific height or only the parts of the area appearing new since the previous section (for brightness 98 or height −1170 μm). The relative area-percentage for the corresponding heights is formed by summing the individual structural elements $a_i$, i.e.

$$\text{relative area-percentage for brightness } 97 = \sum_{i=1}^{n} a_i$$

In FIG. 7 b1 to b3 represent the structural elements of the bearing-area-percentage for a brightness of 97 or height of −1177 μm. The bearing-area-percentage of this height or brightness is formed by summing the individual structural elements $b_i$, i.e.:

$$\text{bearing-area-percentage for height} - 1177\ \mu\text{m} = \sum_{i=1}^{n} b_i$$

By summing the relative area-percentages up to a specific brightness the bearing-area-percentage for this brightness or height can thus be computed, i.e.:

$$\text{bearing-area-\% for brightness } k = \sum_{j=k}^{255} \text{relative area-\% for brightness } j$$

By summing the relative area-percentages from height 0 μm or brightness 255 to height −1177 μm or brightness 97 the bearing-area-percentage is likewise formed, i.e.:

$$\text{bearing-area-\% for height} - 1177\ \mu\text{m} = \sum_{j=97}^{255} \text{relative area-\% for brightness } j$$

To obtain the maximum bearing-area-percentage of 100% at the height −1900 μm or brightness 0 all relative area-percentages from 0 to 255 must be added. This is tabulated on the last page as an example for the fabric SCA 1.

2. The resulting data are then exported to Excel.

Figure 8:
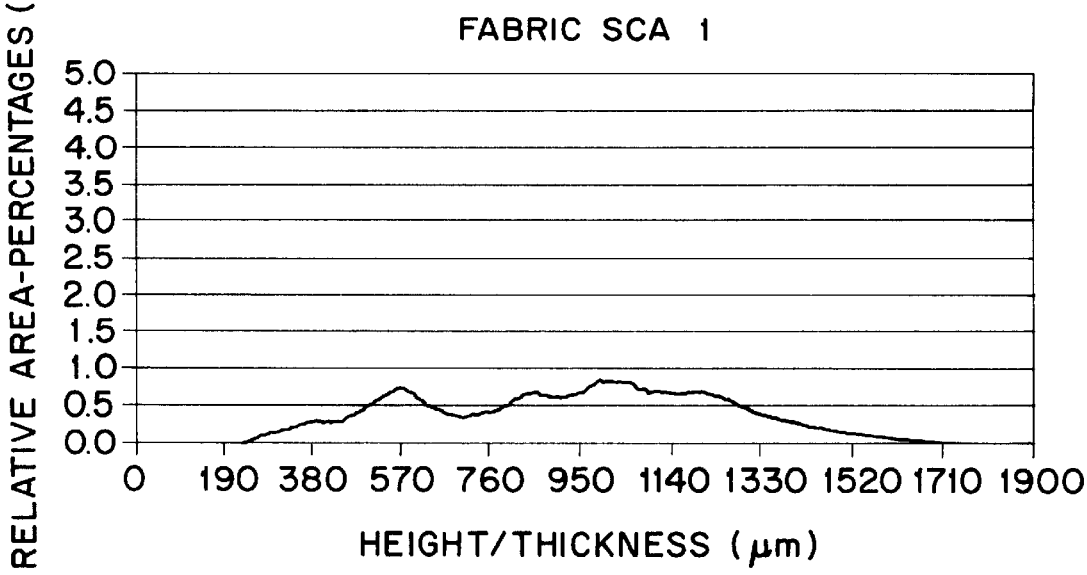
FIG. 8 is a graph plotting the relative area-percentages for SCA 1 fabric, showing relative area-percentages and height/thickness.

3. FIG. 8 plots the relative area-percentages as a function of the thickness as computable from the brightness levels for the fabric SCA 1.

Figure 9:
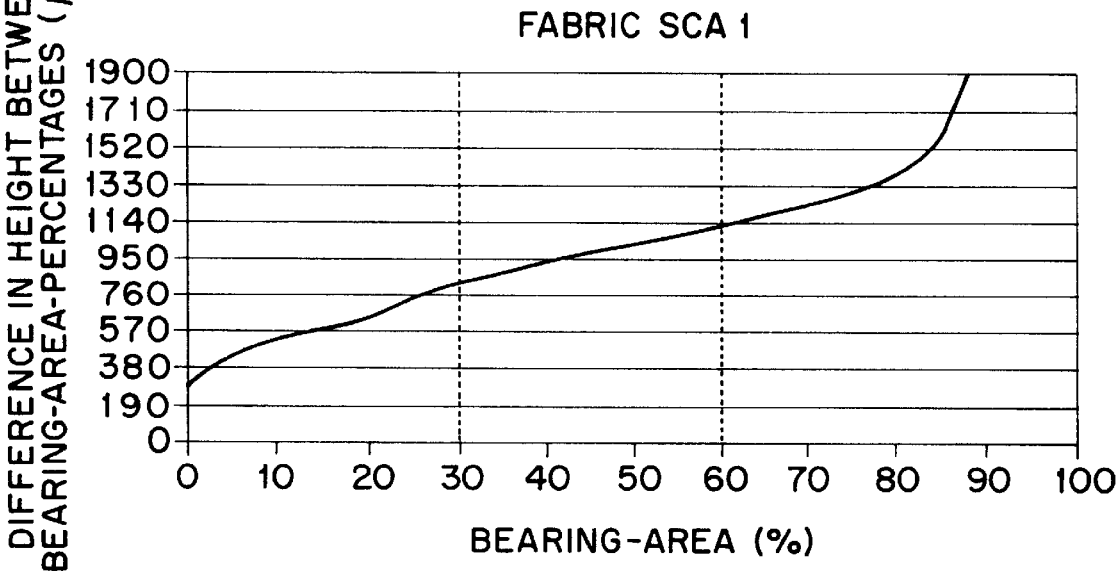
FIG. 9 is a graph plotting the bearing-area-percentage for SCA 1 fabric, showing the difference in height between bearing-area-percentages, and the bearing-area- %.

4. Summing the individual "relative area-percentages" equi-spaced from the sensor (same height or thickness) then computes the bearing-area-percentage. The difference in height is then plotted as a function of the bearing-area-percentage so that the change in height between various bearing-area-percentages can be read off (FIG. 9).

Since the measured fabric SCA 1 was not ground, heights or thicknesses can also be read off for a bearing-area-percentage of less than 30%. For use in the tissue machine the fabric was, however, ground to a contact surface area of 30%, resulting in the profile of the curve making no difference as of a bearing-area-percentage of 30%.

Figure 10:
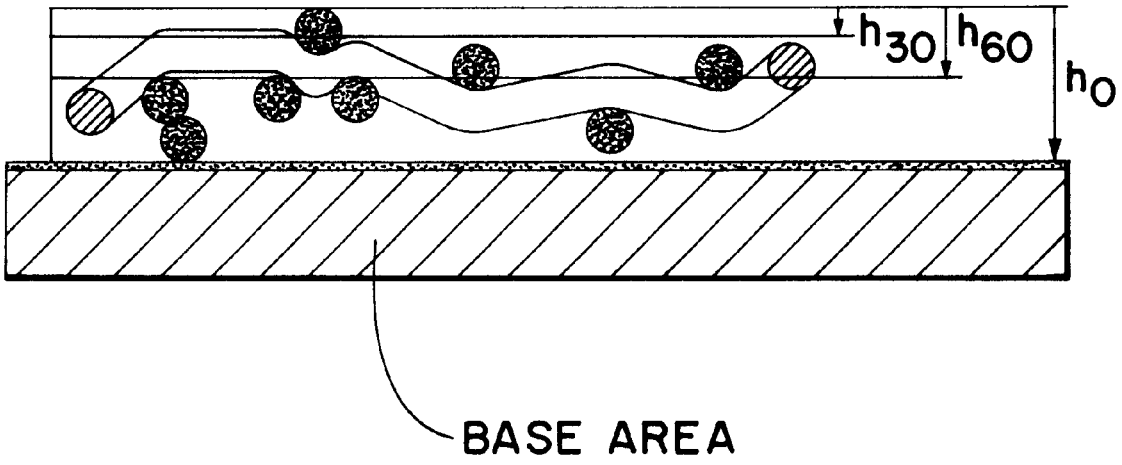
FIG. 10 is an illustration of 30% and 60% bearing-area-percentage.

5. To assess TAD fabrics one of the limit values of the bearing-area-percentage should be 30%. A bearing-area-percentage of 30% needs to be selected because TAD fabrics are usually ground. Expert opinion is that TAD fabrics must not be ground in excess of 30% contact surface area, corresponding to 30% bearing-area-percentage (FIG. 10). Although grinding effects the profile of the bearing-area-percentage between 0 and 30%, it has no effect above 30%, assuming not more than 30% contact surface area is ground. This means that for a certain fabric—irrespective of grinding—the bearing-area-percentage of a ground and non-ground TAD fabric above 30% should be precisely the same.

In comparing several, different single-ply fabrics, this means that the relative area-percentages and bearing-area-percentages in FIG. 2 are all scaled to 30% bearing-area-percentage of a fabric, i.e. the values of all other fabrics are shifted in the Table to a fabric bearing-area-percentage of 30%.

TAD fabrics have nearly always an open area or holes. This is why a bearing-area-percentage of 100% is not achieved in the fabric, at least in theory. Although 100% bearing-area-percentage is indicated in measuring, this is only achieved by incorporating the support material located under the fabric. To cancel out the effects of differing fabric thicknesses and structure of the support material employed when comparing different single-ply fabrics, the range of the bearing-area-percentage needs to be defined upwards (cf. FIGS. 5, 6 defining the result of measuring). The open area of the fabrics amounts to approx. 20 to 30% in most cases. When the bearing-area-percentage is defined to 60%, the result is sufficiently remote from commencement of the result being influenced by the open area (FIG. 10).

When considering only the difference in height between 30% and 60% bearing-area-percentage, the flat fabrics exhibit only a slight difference in height, whereas heavily structured fabrics exhibit a much greater difference in height especially in this range. Table 2 lists the results for analyzing several TAD fabrics as in prior art, on the one hand, and as embodiments in accordance with the invention, on the other, and thus confirm this assumption. Structured fabrics exhibit a difference in height of more than 170 $\mu$m. The fabrics in Table 2 designated as BST, 44 GST, and 44 MST are examples of known fabrics. The fabrics designated as SCA 1, SCA 2, SCA 3, SCA 4, and SCA 5 are different embodiments of the inventive fabrics, and are illustrated in FIGS. 15–19.

VIII. Relative Pocket Depth Percentage

Figure 11:
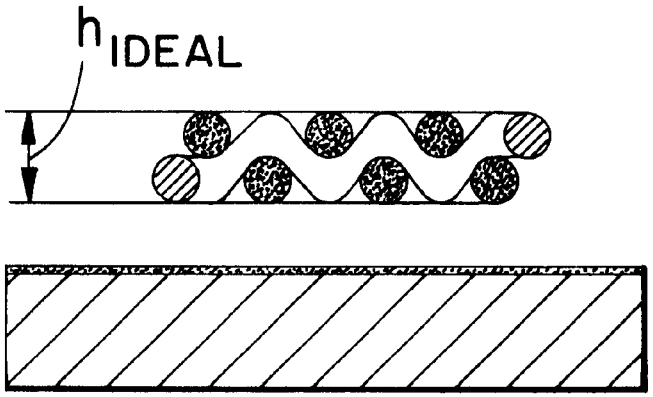
FIG. 11 is an illustration of the idealized fabric thickness.
Figure 12:
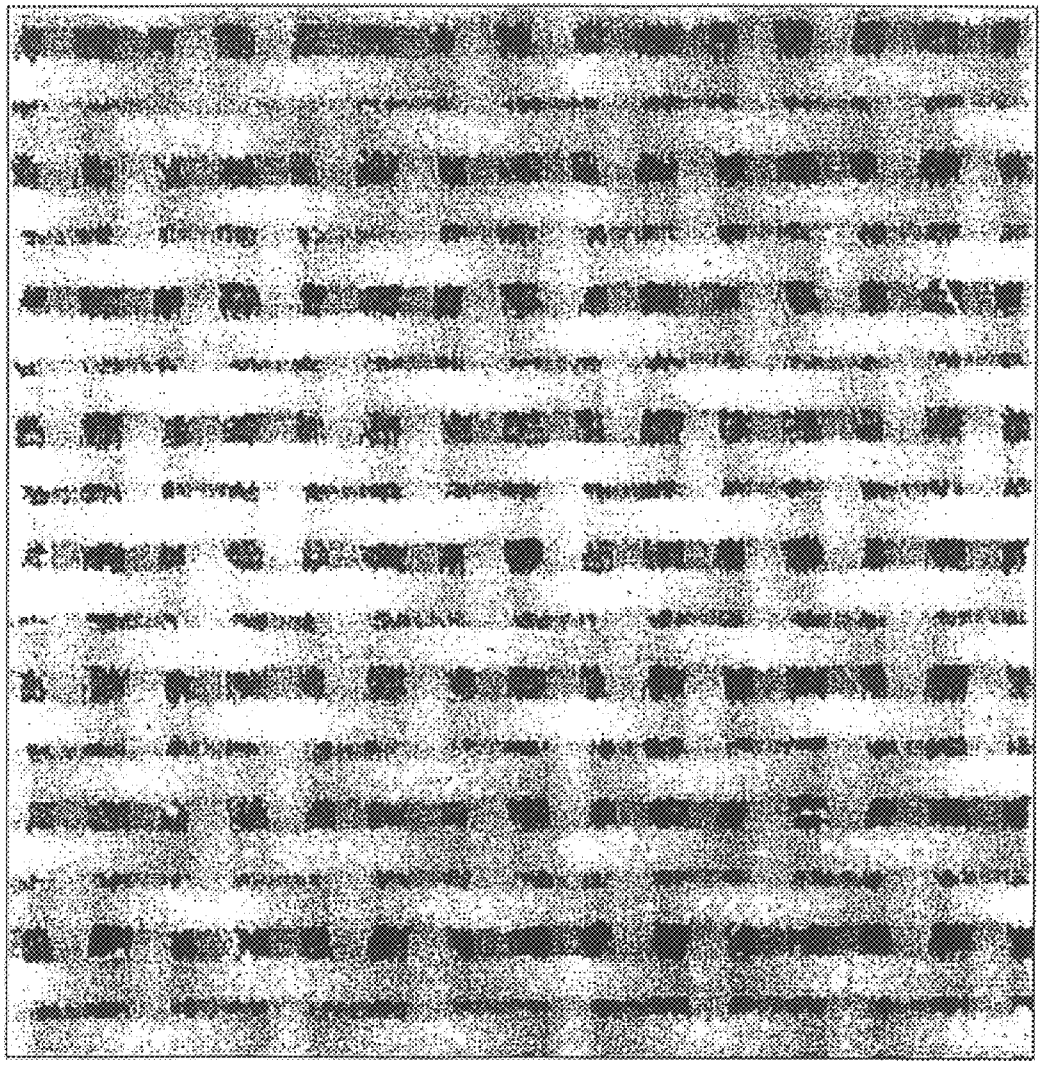
FIG.12 PRIOR ART
FIG. 12 is an illustration of a BST-type comparison fabric as viewed from the paper side.
Figure 13:
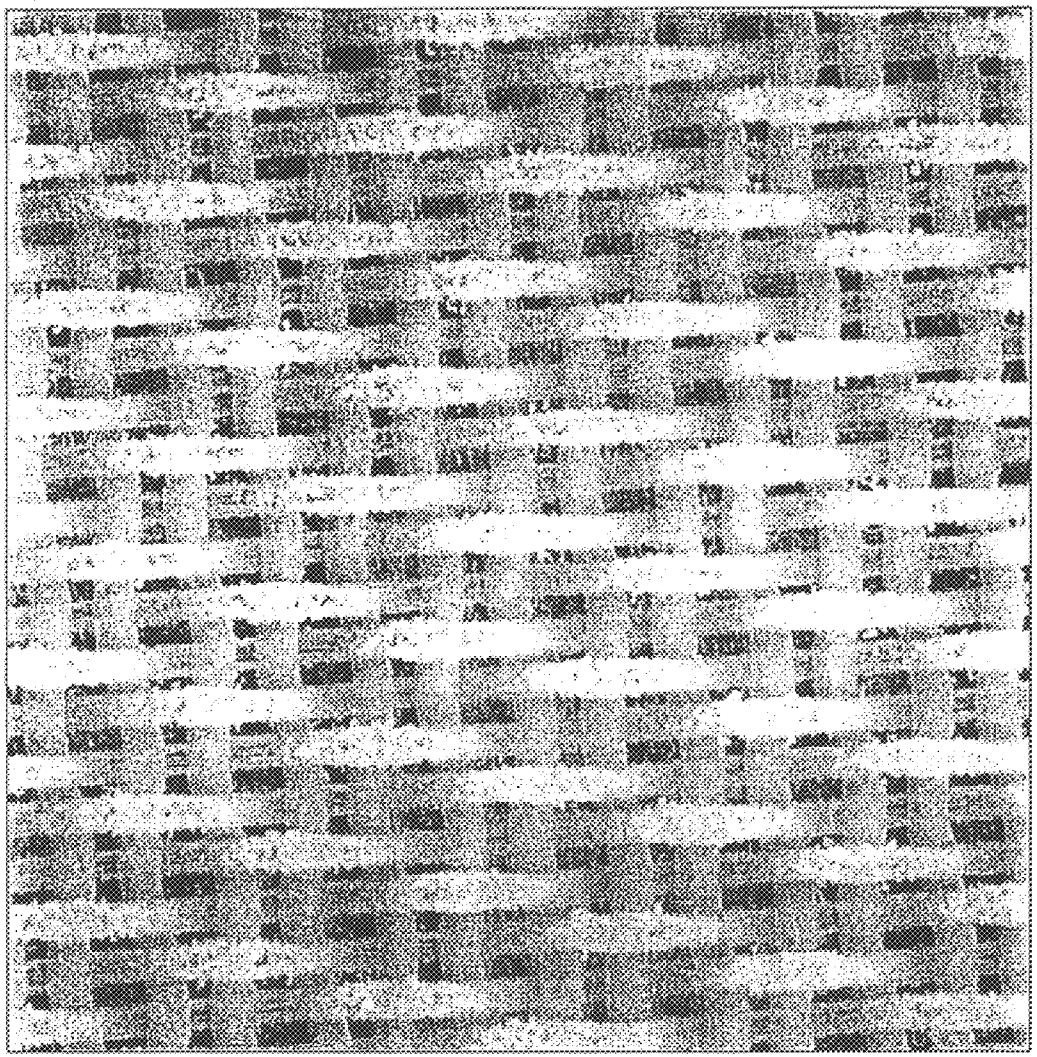
FIG.13 PRIOR ART
FIG. 13 is an illustration of a 44 GST type comparison fabric as viewed from the paper side.
Figure 14:
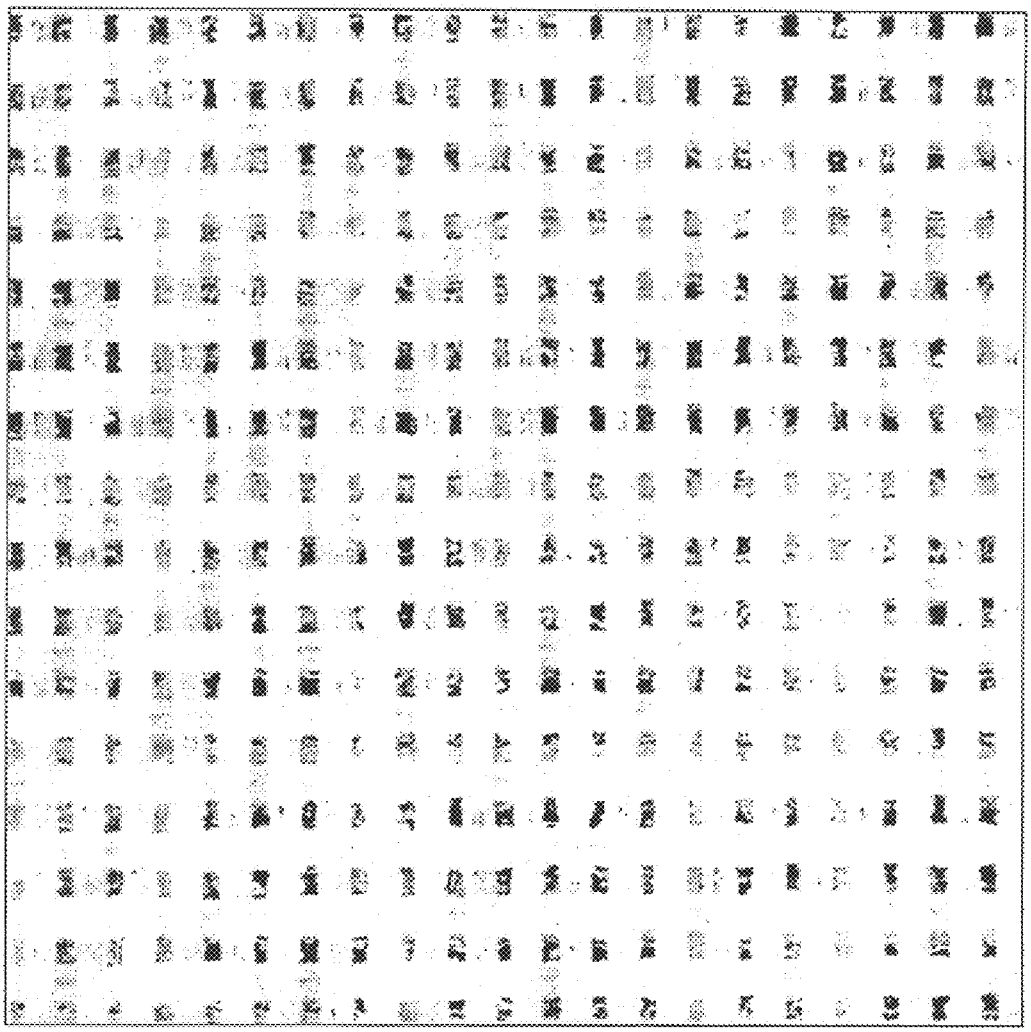
FIG.14 PRIOR ART
FIG. 14 is an illustration of a 44-MST-type comparison fabric as viewed from the paper side.
Figure 15:
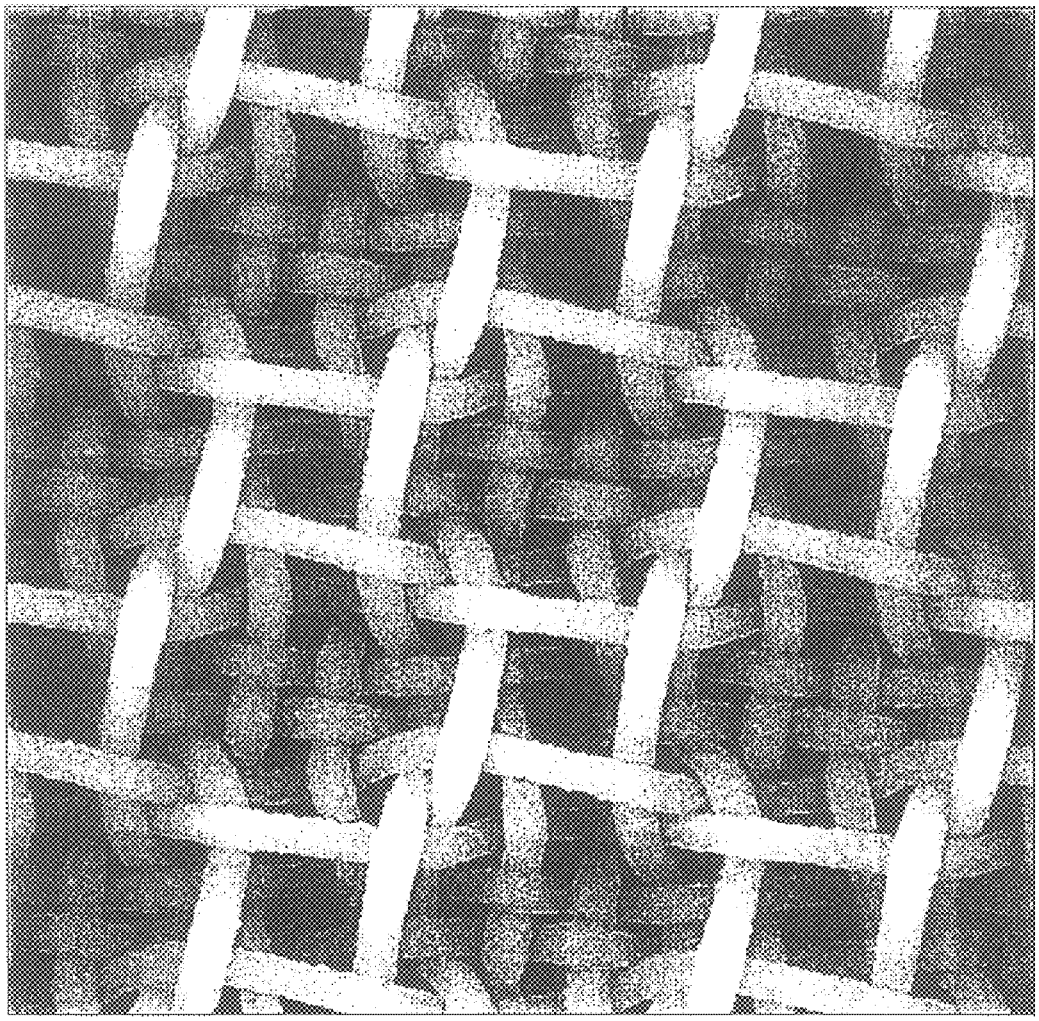
FIG. 15 is an illustration of a SCA-1-type fabric in accordance with an embodiment of the invention as viewed from the paper side.
Figure 16:
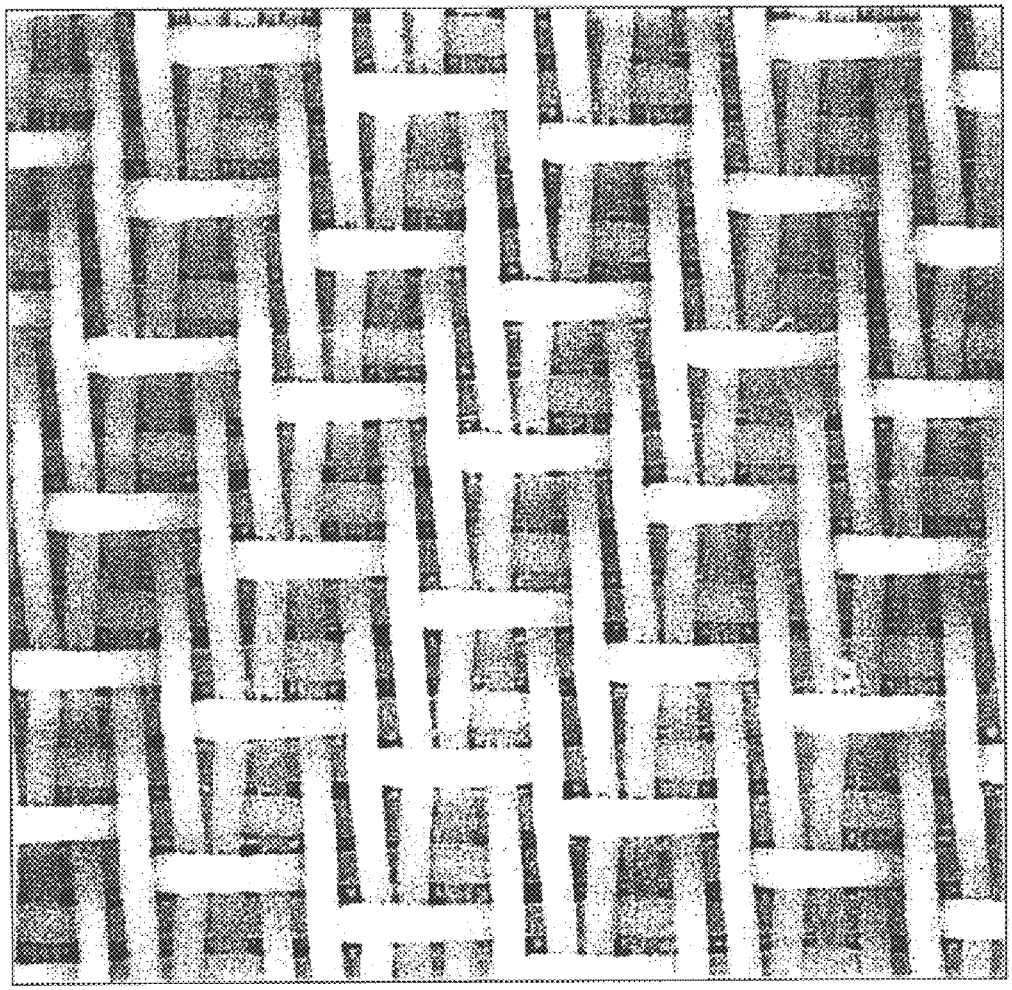
FIG. 16 is an illustration of a SCA-2-type fabric in accordance with an embodiment of the invention as viewed from the paper side.
Figure 17:
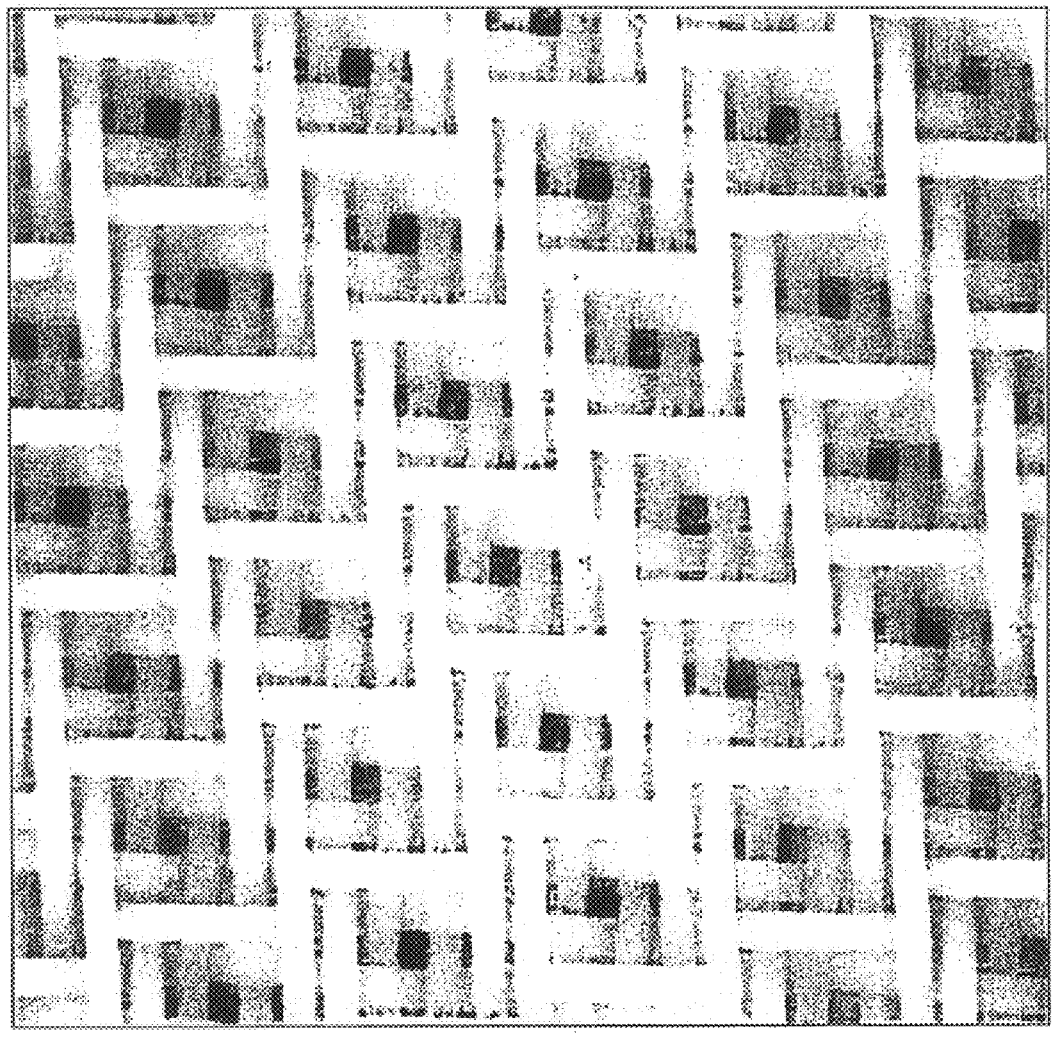
FIG. 17 is an illustration of a SCA-3-type fabric in accordance with an embodiment of the invention as viewed from the paper side.
Figure 18:
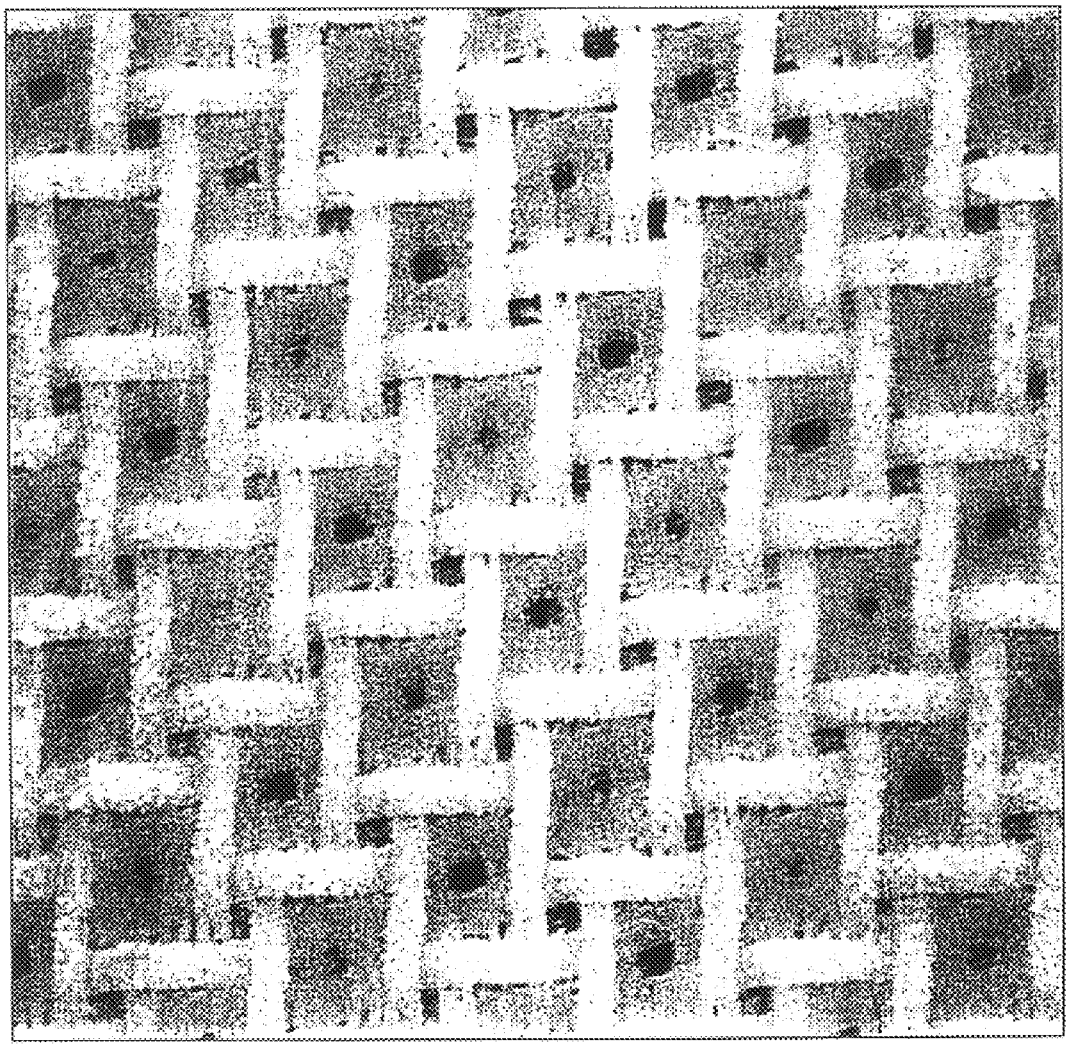
FIG. 18 is an illustration of a SCA-4-type fabric in accordance with an embodiment of the invention as viewed from the paper side.
Figure 19:
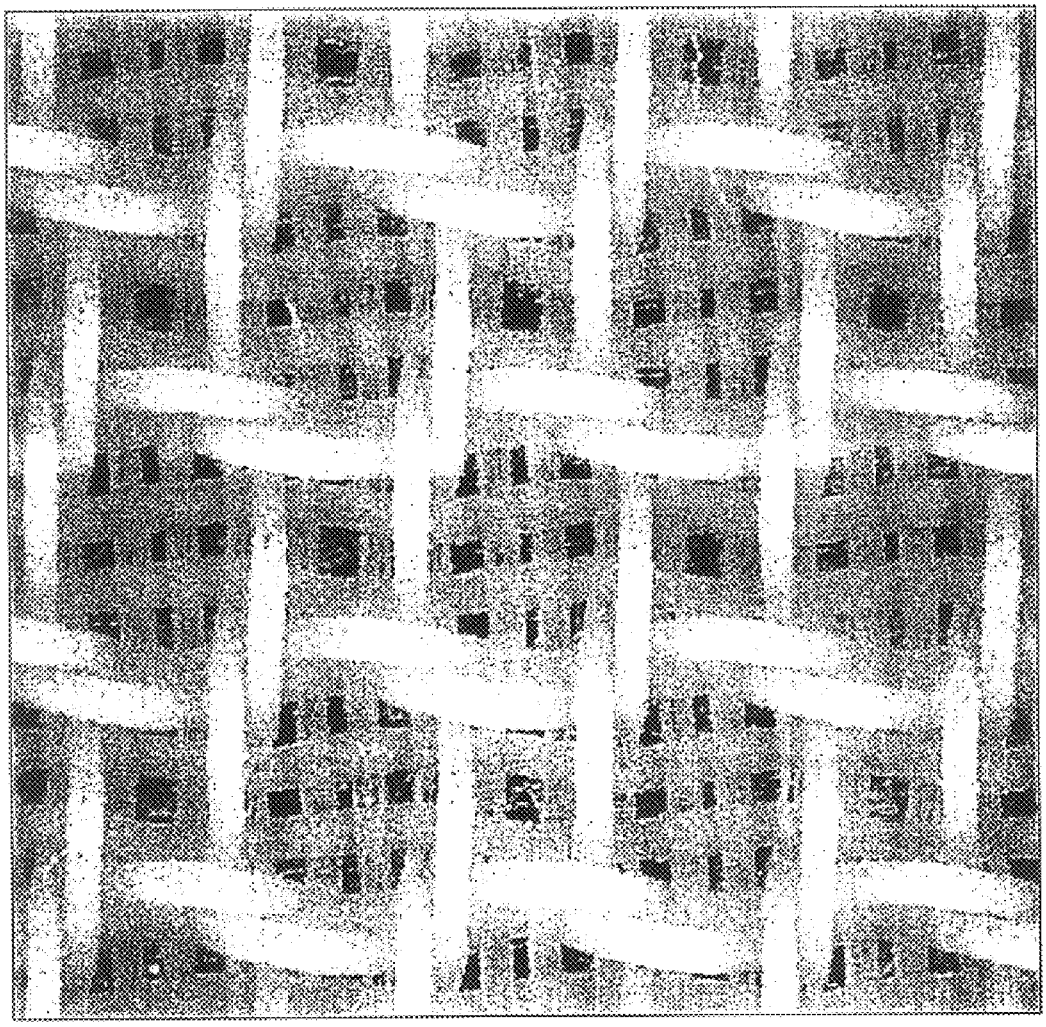
FIG. 19 is an illustration of a SCA-5-type fabric in accordance with an embodiment of the invention as viewed from the paper side.

Due to the above definition the bearing-area-percentage is influenced very strongly by the warp and weft wire diameter employed, i.e. the thicker the wires the greater is the difference in height between 30 and 60% bearing-area-percentage. To eliminate this influence by the wire diameter it is good practice to relate the difference in height between 30 and 60% bearing-area-percentage to the sum of the largest warp and weft wire diameters and to term this classification characteristic the "relative pocket depth". The relative pocket depth is stated as a percentage. The relative pocket depth shows that highly structured fabrics exhibit high values, the borderline between conventional and new fabrics being the value of 20%. Estimated values, i.e. in accordance with the difference in height relativised in FIG. 11 are tabulated in Table. 2.

TABLE 2

RESULTS OF SINGLE-PLY FABRICS

| | BST | 44 GST | 44 MST | SCA 1 | SCA 2 | SCA 3 | SCA 4 | SCA 5 |
|---|---|---|---|---|---|---|---|---|
| Height at 30% Bearing-Area-% | 1080 $\mu$m | 1080 $\mu$m | 1080 $\mu$m | 1080 $\mu$m | 1080 $\mu$m | 1080 $\mu$m | 1080 $\mu$m | 1080 $\mu$m |
| Height at 60% bearing-area-% | 1147 $\mu$m | 976 $\mu$m | 991 $\mu$m | 775 $\mu$m | 872 $\mu$m | 872 $\mu$m | 827 $\mu$m | 909 $\mu$m |
| Difference (30%–60%) | 126 $\mu$m | 104 $\mu$m | 104 $\mu$m | 305 $\mu$m | 208 $\mu$m | 208 $\mu$m | 253 $\mu$m | 171 $\mu$m |
| Diameter of warp and weft threads summed | 800 $\mu$m (400 × 400) | 850 $\mu$m (350 + 500) | 800 $\mu$m (400 × 400) | 850 $\mu$m (400 + 450) | 750 $\mu$m (350 × 400) | 750 $\mu$m (350 × 400) | 800 $\mu$m 350 × 450) | 800 $\mu$m (350 × 450) |
| Bearing-Area-percentage (30–60°) related to threads, i.e. relative pocket depth | 15.8% | 12.2% | 11.1% | 31.7% | 27.7% | 27.7% | 31.6% | 21.4% |

Tabulated in the Table on the next page are the relative area-percentages associated with the various heights computed from the brightness levels (as established by the PercentArea tool in the Optimas program) and the bearing-area-percentages computed therefrom for the SCA 1 fabric. It was with these numerical values that the plots as shown in FIGS. 8 and 9 were produced.

| 1 | A Bright-ness level | B Height [μm] | C Rel. Area % [%] | D Area Bearing % [%] | E | F Bright-ness level | G Height [μm] | H Rel. Area % [%] | I Area Bearing % [%] | J | K Bright-ness level | L Height [μm] | M Rel. Area % [%] | N Area Bearing % [%] | O | P Bright-ness level | Q Height [μm] | R Rel. Area % [%] | S Area Bearing % [%] |
|---|---|---|---|---|---|---|---|---|---|---|---|---|---|---|---|---|---|---|---|
| 2 | 0 | −1900 | 9.943 | 100.000 | | 64 | −1423 | 0.081 | 85.351 | | 128 | −946 | 0.654 | 62.134 | | 192 | −469 | 0.386 | 21.895 |
| 3 | 1 | −1893 | 0.113 | 90.057 | | 65 | −1416 | 0.100 | 85.270 | | 129 | −939 | 0.681 | 61.480 | | 193 | −462 | 0.424 | 21.509 |
| 4 | 2 | −1885 | 0.103 | 89.944 | | 66 | −1408 | 0.097 | 85.170 | | 130 | −931 | 0.674 | 60.799 | | 194 | −455 | 0.429 | 21.085 |
| 5 | 3 | −1878 | 0.105 | 89.841 | | 67 | −1401 | 0.097 | 85.073 | | 131 | −924 | 0.689 | 60.125 | | 195 | −447 | 0.448 | 20.657 |
| 6 | 4 | −1870 | 0.099 | 89.735 | | 68 | −1393 | 0.104 | 84.977 | | 132 | −916 | 0.717 | 59.437 | | 196 | −440 | 0.462 | 20.208 |
| 7 | 5 | −1863 | 0.100 | 89.636 | | 69 | −1386 | 0.109 | 84.873 | | 133 | −909 | 0.709 | 58.720 | | 197 | −432 | 0.484 | 19.746 |
| 8 | 6 | −1855 | 0.094 | 89.536 | | 70 | −1378 | 0.107 | 84.764 | | 134 | −902 | 0.707 | 58.011 | | 198 | −425 | 0.512 | 19.262 |
| 9 | 7 | −1848 | 0.090 | 89.442 | | 71 | −1371 | 0.112 | 84.657 | | 135 | −894 | 0.685 | 57.303 | | 199 | −417 | 0.574 | 18.751 |
| 10 | 8 | −1840 | 0.095 | 89.352 | | 72 | −1364 | 0.113 | 84.545 | | 136 | −887 | 0.744 | 56.618 | | 200 | −410 | 0.600 | 18.177 |
| 11 | 9 | −1833 | 0.087 | 89.256 | | 73 | −1356 | 0.104 | 84.432 | | 137 | −879 | 0.725 | 55.874 | | 201 | −402 | 0.631 | 17.577 |
| 12 | 10 | −1825 | 0.089 | 89.170 | | 74 | −1349 | 0.134 | 84.328 | | 138 | −872 | 0.739 | 55.149 | | 202 | −395 | 0.670 | 16.946 |
| 13 | 11 | −1818 | 0.076 | 89.080 | | 75 | −1341 | 0.120 | 84.194 | | 139 | −864 | 0.784 | 54.410 | | 203 | −387 | 0.702 | 16.275 |
| 14 | 12 | −1811 | 0.084 | 89.004 | | 76 | −1334 | 0.145 | 84.074 | | 140 | −857 | 0.832 | 53.625 | | 204 | −380 | 0.741 | 15.574 |
| 15 | 13 | −1803 | 0.086 | 88.921 | | 77 | −1326 | 0.134 | 83.929 | | 141 | −849 | 0.818 | 52.794 | | 205 | −373 | 0.713 | 14.832 |
| 16 | 14 | −1796 | 0.087 | 88.835 | | 78 | −1319 | 0.167 | 83.795 | | 142 | −842 | 0.835 | 51.975 | | 206 | −365 | 0.720 | 14.120 |
| 17 | 15 | −1788 | 0.082 | 88.748 | | 79 | −1311 | 0.168 | 83.628 | | 143 | −835 | 0.826 | 51.140 | | 207 | −358 | 0.682 | 13.400 |
| 18 | 16 | −1781 | 0.083 | 88.666 | | 80 | −1304 | 0.174 | 83.460 | | 144 | −827 | 0.828 | 50.314 | | 208 | −350 | 0.680 | 12.718 |
| 19 | 17 | −1773 | 0.072 | 88.582 | | 81 | −1296 | 0.177 | 83.286 | | 145 | −820 | 0.842 | 49.486 | | 209 | −343 | 0.634 | 12.038 |
| 20 | 18 | −1766 | 0.078 | 88.511 | | 82 | −1289 | 0.182 | 83.109 | | 146 | −812 | 0.835 | 48.643 | | 210 | −335 | 0.612 | 11.404 |
| 21 | 19 | −1758 | 0.073 | 88.433 | | 83 | −1282 | 0.190 | 82.926 | | 147 | −805 | 0.854 | 47.808 | | 211 | −328 | 0.587 | 10.792 |
| 22 | 20 | −1751 | 0.075 | 88.360 | | 84 | −1274 | 0.192 | 82.736 | | 148 | −797 | 0.812 | 46.954 | | 212 | −320 | 0.560 | 10.205 |
| 23 | 21 | −1744 | 0.069 | 88.285 | | 85 | −1267 | 0.209 | 82.544 | | 149 | −790 | 0.858 | 46.142 | | 213 | −313 | 0.533 | 9.645 |
| 24 | 22 | −1736 | 0.071 | 88.216 | | 86 | −1259 | 0.230 | 82.335 | | 150 | −782 | 0.818 | 45.285 | | 214 | −305 | 0.484 | 9.112 |
| 25 | 23 | −1729 | 0.067 | 88.145 | | 87 | −1252 | 0.221 | 82.105 | | 151 | −775 | 0.762 | 44.467 | | 215 | −298 | 0.458 | 8.628 |
| 26 | 24 | −1721 | 0.069 | 88.078 | | 88 | −1244 | 0.233 | 81.883 | | 152 | −767 | 0.753 | 43.705 | | 216 | −291 | 0.446 | 8.170 |
| 27 | 25 | −1714 | 0.061 | 88.009 | | 89 | −1237 | 0.244 | 81.650 | | 153 | −760 | 0.712 | 42.951 | | 217 | −283 | 0.408 | 7.724 |
| 28 | 26 | −1706 | 0.070 | 87.949 | | 90 | −1229 | 0.256 | 81.406 | | 154 | −753 | 0.676 | 42.239 | | 218 | −276 | 0.394 | 7.316 |
| 29 | 27 | −1699 | 0.068 | 87.878 | | 91 | −1222 | 0.275 | 81.150 | | 155 | −745 | 0.672 | 41.563 | | 219 | −268 | 0.364 | 6.922 |
| 30 | 28 | −1691 | 0.067 | 87.810 | | 92 | −1215 | 0.288 | 80.875 | | 156 | −738 | 0.661 | 40.891 | | 220 | −261 | 0.358 | 6.558 |
| 31 | 29 | −1684 | 0.066 | 87.743 | | 93 | −1207 | 0.287 | 80.586 | | 157 | −730 | 0.641 | 40.230 | | 221 | −253 | 0.318 | 6.200 |
| 32 | 30 | −1676 | 0.069 | 87.677 | | 94 | −1200 | 0.311 | 80.299 | | 158 | −723 | 0.627 | 39.589 | | 222 | −246 | 0.300 | 5.883 |
| 33 | 31 | −1669 | 0.069 | 87.608 | | 95 | −1192 | 0.336 | 79.989 | | 159 | −715 | 0.642 | 38.962 | | 223 | −238 | 0.280 | 5.583 |
| 34 | 32 | −1662 | 0.062 | 87.539 | | 96 | −1185 | 0.315 | 79.653 | | 160 | −708 | 0.598 | 38.320 | | 224 | −231 | 0.295 | 5.303 |
| 35 | 33 | −1654 | 0.061 | 87.477 | | 97 | −1177 | 0.340 | 79.338 | | 161 | −700 | 0.633 | 37.723 | | 225 | −224 | 0.285 | 5.008 |
| 36 | 34 | −1647 | 0.060 | 87.416 | | 98 | −1170 | 0.334 | 78.998 | | 162 | −693 | 0.627 | 37.090 | | 226 | −216 | 0.286 | 4.723 |
| 37 | 35 | −1639 | 0.065 | 87.356 | | 99 | −1162 | 0.365 | 78.664 | | 163 | −685 | 0.620 | 36.463 | | 227 | −209 | 0.272 | 4.437 |
| 38 | 36 | −1632 | 0.066 | 87.291 | | 100 | −1155 | 0.360 | 78.298 | | 164 | −678 | 0.649 | 35.843 | | 228 | −201 | 0.304 | 4.165 |
| 39 | 37 | −1624 | 0.056 | 87.225 | | 101 | −1147 | 0.383 | 77.939 | | 165 | −671 | 0.661 | 35.194 | | 229 | −194 | 0.293 | 3.861 |
| 40 | 38 | −1617 | 0.063 | 87.168 | | 102 | −1140 | 0.398 | 77.555 | | 166 | −663 | 0.648 | 34.533 | | 230 | −186 | 0.315 | 3.569 |
| 41 | 39 | −1609 | 0.061 | 87.106 | | 103 | −1133 | 0.405 | 77.158 | | 167 | −656 | 0.695 | 33.886 | | 231 | −179 | 0.295 | 3.254 |
| 42 | 40 | −1602 | 0.067 | 87.045 | | 104 | −1125 | 0.425 | 76.753 | | 168 | −648 | 0.669 | 33.190 | | 232 | −171 | 0.274 | 2.959 |
| 43 | 41 | −1595 | 0.061 | 86.978 | | 105 | −1118 | 0.442 | 76.327 | | 169 | −641 | 0.653 | 32.522 | | 233 | −164 | 0.289 | 2.685 |
| 44 | 42 | −1587 | 0.063 | 86.917 | | 106 | −1110 | 0.450 | 75.885 | | 170 | −633 | 0.657 | 31.868 | | 234 | −156 | 0.259 | 2.395 |

-continued

| 1 | A Bright-ness level | B Height [μm] | C Rel. Area % [%] | D Area Bearing % [%] | E | F Bright-ness level | G Height [μm] | H Rel. Area % [%] | I Area Bearing % [%] | J | K Bright-ness level | L Height [μm] | M Rel. Area % [%] | N Area Bearing % [%] | O | P Bright-ness level | Q Height [μm] | R Rel. Area % [%] | S Area Bearing % [%] |
|---|---|---|---|---|---|---|---|---|---|---|---|---|---|---|---|---|---|---|---|
| 45 | 43 | −1580 | 0.065 | 86.854 | | 107 | −1103 | 0.475 | 75.434 | | 171 | −626 | 0.643 | 31.211 | | 235 | −149 | 0.242 | 2.136 |
| 46 | 44 | −1572 | 0.062 | 86.790 | | 108 | −1095 | 0.500 | 74.960 | | 172 | −618 | 0.585 | 30.568 | | 236 | −142 | 0.238 | 1.895 |
| 47 | 45 | −1565 | 0.063 | 86.728 | | 109 | −1088 | 0.528 | 74.460 | | 173 | −611 | 0.566 | 29.984 | | 237 | −134 | 0.190 | 1.657 |
| 48 | 46 | −1557 | 0.068 | 86.665 | | 110 | −1080 | 0.535 | 73.932 | | 174 | −604 | 0.561 | 29.417 | | 238 | −127 | 0.196 | 1.467 |
| 49 | 47 | −1550 | 0.061 | 86.596 | | 111 | −1073 | 0.545 | 73.397 | | 175 | −596 | 0.517 | 28.856 | | 239 | −119 | 0.171 | 1.271 |
| 50 | 48 | −1542 | 0.069 | 86.535 | | 112 | −1065 | 0.592 | 72.852 | | 176 | −589 | 0.512 | 28.339 | | 240 | −112 | 0.158 | 1.100 |
| 51 | 49 | −1535 | 0.061 | 86.466 | | 113 | −1058 | 0.605 | 72.260 | | 177 | −581 | 0.466 | 27.827 | | 241 | −104 | 0.153 | 0.942 |
| 52 | 50 | −1527 | 0.072 | 86.405 | | 114 | −1051 | 0.626 | 71.655 | | 178 | −574 | 0.448 | 27.361 | | 242 | −97 | 0.138 | 0.789 |
| 53 | 51 | −1520 | 0.074 | 86.333 | | 115 | −1043 | 0.634 | 71.029 | | 179 | −566 | 0.442 | 26.913 | | 243 | −89 | 0.117 | 0.651 |
| 54 | 52 | −1513 | 0.068 | 86.259 | | 116 | −1036 | 0.674 | 70.395 | | 180 | −559 | 0.423 | 26.471 | | 244 | −82 | 0.120 | 0.535 |
| 55 | 53 | −1505 | 0.069 | 86.191 | | 117 | −1028 | 0.661 | 69.722 | | 181 | −551 | 0.413 | 26.048 | | 245 | −75 | 0.104 | 0.414 |
| 56 | 54 | −1498 | 0.066 | 86.122 | | 118 | −1021 | 0.699 | 69.060 | | 182 | −544 | 0.420 | 25.636 | | 246 | −67 | 0.091 | 0.311 |
| 57 | 55 | −1490 | 0.066 | 86.056 | | 119 | −1013 | 0.691 | 68.362 | | 183 | −536 | 0.392 | 25.216 | | 247 | −60 | 0.066 | 0.220 |
| 58 | 56 | −1483 | 0.080 | 85.990 | | 120 | −1006 | 0.715 | 67.671 | | 184 | −529 | 0.367 | 24.824 | | 248 | −52 | 0.054 | 0.154 |
| 59 | 57 | −1475 | 0.077 | 85.910 | | 121 | −998 | 0.710 | 66.956 | | 185 | −522 | 0.387 | 24.457 | | 249 | −45 | 0.043 | 0.100 |
| 60 | 58 | −1468 | 0.078 | 85.833 | | 122 | −991 | 0.714 | 66.245 | | 186 | −514 | 0.355 | 24.070 | | 250 | −37 | 0.022 | 0.057 |
| 61 | 59 | −1460 | 0.078 | 85.755 | | 123 | −984 | 0.684 | 65.531 | | 187 | −507 | 0.340 | 23.715 | | 251 | −30 | 0.021 | 0.035 |
| 62 | 60 | −1453 | 0.076 | 85.677 | | 124 | −976 | 0.696 | 64.847 | | 188 | −499 | 0.352 | 23.375 | | 252 | −22 | 0.007 | 0.014 |
| 63 | 61 | −1445 | 0.073 | 85.601 | | 125 | −969 | 0.695 | 64.151 | | 189 | −492 | 0.365 | 23.023 | | 253 | −15 | 0.003 | 0.006 |
| 64 | 62 | −1438 | 0.089 | 85.529 | | 126 | −961 | 0.660 | 63.456 | | 190 | −484 | 0.380 | 22.658 | | 254 | −7 | 0.002 | 0.003 |
| 65 | 63 | −1431 | 0.089 | 85.440 | | 127 | −954 | 0.663 | 62.796 | | 191 | −477 | 0.383 | 22.278 | | 255 | 0 | 0.001 | 0.001 |

"Bearing-area-percentage" in the sense of the method of evaluation in accordance with the invention is defined as the surface to be measured which would contact planarly with an imaginary contact surface area having a geometrically ideal planar surface without the effect of a squeezing force when the warp and weft wires of the fabric cloth in coming from above from the highest point of contact are progressively reduced in thickness quasi continuously, with it having to be noted In this arrangement that due to grinding, the actual surface area, i.e. also the reduction in the warp or weft wire areas, is taken into account whilst a laser sensor below the largest contact surface area only "sees" their projection. For example, this theoretical consideration may be undertaken within the two limits 30% and 60% bearing-area-percentage.

As regards defining the projected section area the following is to be noted. In height measuring using e.g. a laser sensor it must be taken into account that the sectional area measured is not the true sectional area but the projected sectional area. This is a projected sectional area because measuring is done at right angles to the surface of the object measured from above downwards and the laser is unable to "see" contours concealed by overlaps e.g. such as those below the largest extent of a wire. This is why the "sectional area", e.g. of a wire, no longer becomes smaller when height ranges are measured located below the largest extent of the wire forming the contour. This optically necessitated section area is the projected section area.

The following further definitions are given for the relative pocket depth, measuring height "0" and bearing-area-percentage. The relative pocket depth is the quotient of the difference in height between the measuring height at which the bearing-area-percentage is 30% and the measuring height at which the bearing-area-percentage is 60% and the sum of the diameters of a weft wire and a warp wire. Measuring height "0" is the outer limit of the paper-making-machine fabric on the paper contact side. The bearing-area-percentage is the projected area of the sectional wires of the fabric at a specific measuring height divided by the measuring area, wherein the sectional planes are located parallel to the surface of the fabric.

When comparing conventionally woven and subsequently conventionally heat set, single-ply TAD fabrics to embodiments in accordance with the invention, it is obvious that conventional fabrics of this kind are clearly below a critical value whereas embodiments of the TAD fabrics in accordance with the invention are above this critical value.

The "characteristic critical value" of embodiments in accordance with the invention of single-ply TAD fabrics is defined as the "relative pocket depth" permitting an indication of the suitability of a TAD pocket in accordance with the invention irrespective of the selected warp and weft wire diameter of the fabric selected in each case. Relativizing the system in this way is done by relating the difference in height between the height for a bearing-area-percentage of 30% and the height for a bearing-area-percentage of 60% to the sum of the weft and warp wire diameters.

The "characteristic critical value" for selecting embodiments in accordance with the invention is a "relative pocket depth" of >/=20%, preferably >/=24% and most preferably >/=27%. Conventional TAD fabric specimen exhibit a "relative pocket depth" significantly below 20%.

Stipulating a "relative pocket depth" is good practice since the optimising method is intended to furnish a selection in comparing TAD fabric structures of equal weft and warp wire diameter, the added thickness for an increase in the weft and warp wire diameter being negligible by contrast.

What is claimed is:

1. A paper-making-machine fabric, in the form of a woven pattern, wherein a relative pocket depth of pockets in the paper-making-machine fabric open towards a paper contact side of the fabric amounts to 20% or more, where the relative pocket depth is the quotient of the difference in height between the measuring height at which the bearing-area-percentage is 30% and the measuring height at which the bearing-area-percentage is 60% and the sum of the diameters of a weft wire and a warp wire, a measuring height "0" is the outer limit of the paper-making-machine fabric on the paper contact side, the bearing-area-percentage is the projected area of sectional wires of the fabric at a specific measuring height divided by the measuring area wherein the sectional planes are located parallel to the surface of the fabric.

2. The paper-making-machine fabric as set forth in claim 1, wherein the relative pocket depth amounts to 24% or more.

3. The paper-making-machine fabric as set forth in claim 1, wherein the relative pocket depth amounts to 27% or more.

4. The paper-making-machine fabric as set forth in claim 1, wherein the fabric comprises a woven pattern regularly repeated over a surface area.

5. The paper-making-machine fabric as set forth in claim 1, wherein the fabric comprises a woven pattern irregularly distributed over a surface area

6. A tissue-paper product produced with a paper-making-machine fabric as set forth in claim 1.

7. A paper-making-machine fabric in the form of a woven pattern, wherein a relative pocket depth of pockets in the paper-making-machine fabric open towards a paper contact side of the fabric amounts to 20% or more, wherein the relative pocket depth is the quotient of the difference in height between the measuring height at which the bearing-area-percentage is 30% and the measuring height at which the bearing-area-percentage is 60% and the sum of the diameters of a weft wire and a warp wire, a measuring height "0" is the outer limit of the paper-making-machine fabric on the paper contact side, the bearing-area-percentage is the projected area of sectional wires of the fabric at a specific measuring height divided by the measuring area wherein the sectional planes are located parallel to the surface of the fabric, wherein the fabric is single-ply.

8. The paper-making-machine fabric as set forth in claim 7, wherein the relative pocket depth amounts to 24% or more.

9. The paper-making-machine fabric as set forth in claim 7, wherein the relative pocket depth amounts to 27% or more.

10. The paper-making-machine fabric as set forth in claim 7, wherein the fabric comprises a woven pattern regularly repeated over a surface area.

11. The paper-making-machine fabric as set forth in claim 7, wherein the fabric comprises a woven pattern irregularly distributed over a surface area.

12. A tissue-paper product produced with a paper-making-machine fabric as set forth in claim 7.

* * * * *